US009276316B2

(12) United States Patent
Chi et al.

(10) Patent No.: US 9,276,316 B2
(45) Date of Patent: Mar. 1, 2016

(54) ANTENNA MODULE AND WIRELESS COMMUNICATION DEVICE EMPLOYING SAME

(71) Applicant: FIH (Hong Kong) Limited, Kowloon (HK)

(72) Inventors: Chuan-Chou Chi, New Taipei (TW); Chih-Yang Tsai, New Taipei (TW); Chi-Sheng Liu, New Taipei (TW); Hao-Ying Chang, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 543 days.

(21) Appl. No.: 13/693,046

(22) Filed: Dec. 4, 2012

(65) Prior Publication Data

US 2013/0229312 A1 Sep. 5, 2013

(30) Foreign Application Priority Data

Mar. 1, 2012 (TW) ..... 101106826 A

(51) Int. Cl.

| | |
|---|---|
| ***H01Q 1/38*** | (2006.01) |
| ***H01Q 5/00*** | (2015.01) |
| ***H01Q 1/24*** | (2006.01) |
| ***H01Q 9/42*** | (2006.01) |
| ***H01Q 5/378*** | (2015.01) |

(52) U.S. Cl.
CPC ..... *H01Q 5/0055* (2013.01); *H01Q 1/243* (2013.01); *H01Q 5/378* (2015.01); *H01Q 9/42* (2013.01)

(58) Field of Classification Search
USPC ..... 343/700 MS, 702
See application file for complete search history.

(56) References Cited

U.S. PATENT DOCUMENTS

| | | | | |
|---|---|---|---|---|
| 2005/0248492 | A1* | 11/2005 | Ryu | H01Q 9/0407 343/702 |
| 2009/0224982 | A1* | 9/2009 | Isoda | H01Q 1/243 343/702 |
| 2011/0156965 | A1* | 6/2011 | Ma | H01Q 1/2266 343/702 |

* cited by examiner

*Primary Examiner* — Hoang V Nguyen
*Assistant Examiner* — Hai Tran
(74) *Attorney, Agent, or Firm* — Novak Druce Connolly Bove + Quigg LLP

(57) ABSTRACT

An antenna module includes an antenna, a connecting member attached to the antenna, a sliding board configured for sliding relative to connecting member, and a radiation member attached to the sliding board. When the sliding board is slid by a user, the radiation member makes contact with or separates from the connecting member, enabling one antenna module to receive and transmit wireless signals of different wavelengths.

15 Claims, 4 Drawing Sheets

ANTENNA MODULE AND WIRELESS COMMUNICATION DEVICE EMPLOYING SAME

BACKGROUND

1. Technical Field

The present disclosure relates to antenna modules and wireless communication devices employing the antenna modules.

2. Description of Related Art

Many wireless communication devices (such as mobile phones) have multiple frequency bands. Thus, multiple antennas are secured inside the devices, such as a GSM/CDMA wireless communication antenna, a WIFI antenna, and a GPS antenna. These antennas are located at different positions inside the devices to prevent mutual interference. However, multiple antennas require an increased manufacturing cost. Moreover, multiple antennas occupy more space, making it difficult to miniaturize the wireless communication devices.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
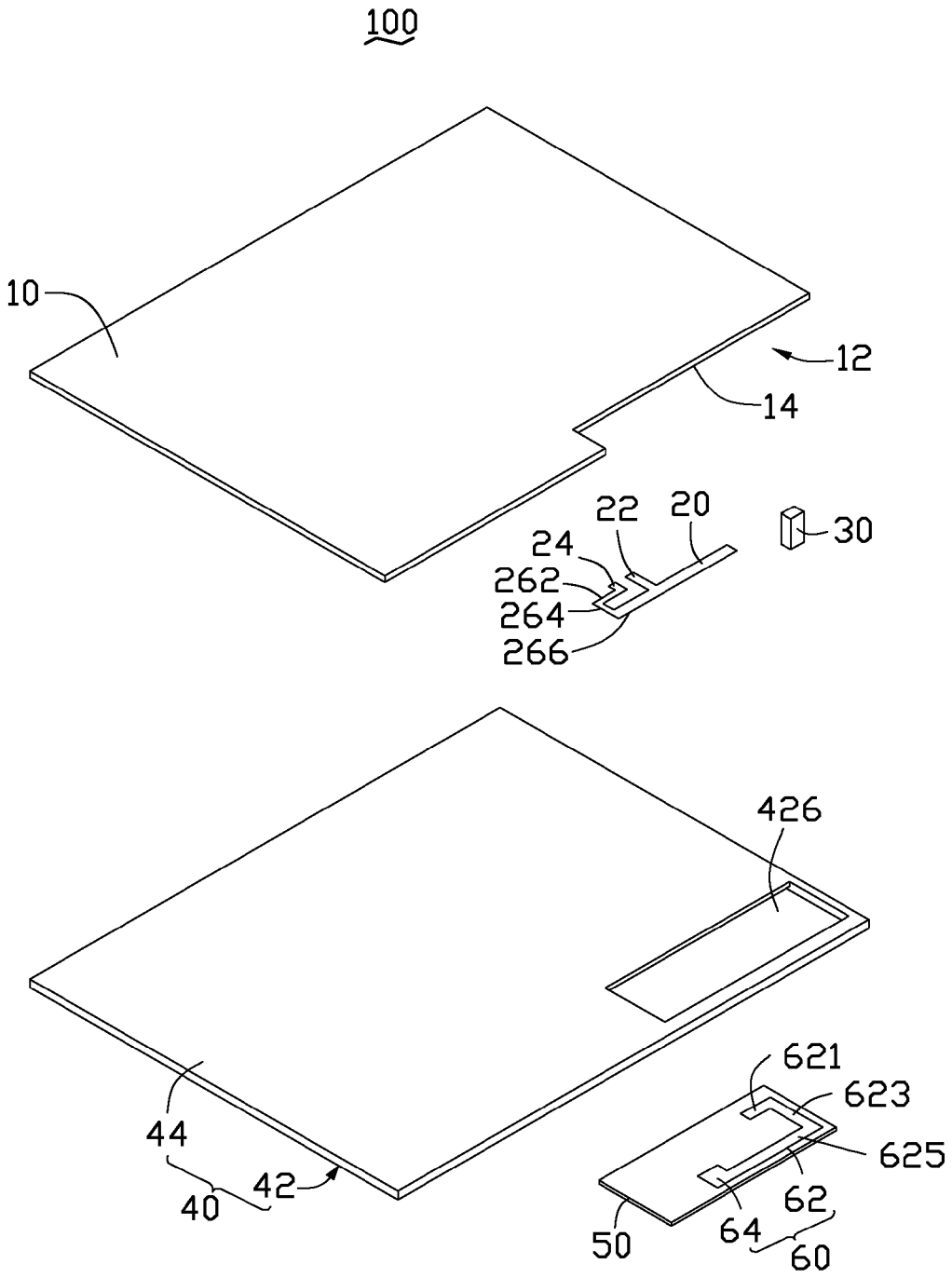
FIG. 1 is an exploded view of an antenna module in accordance with an exemplary embodiment.
Figure 2:
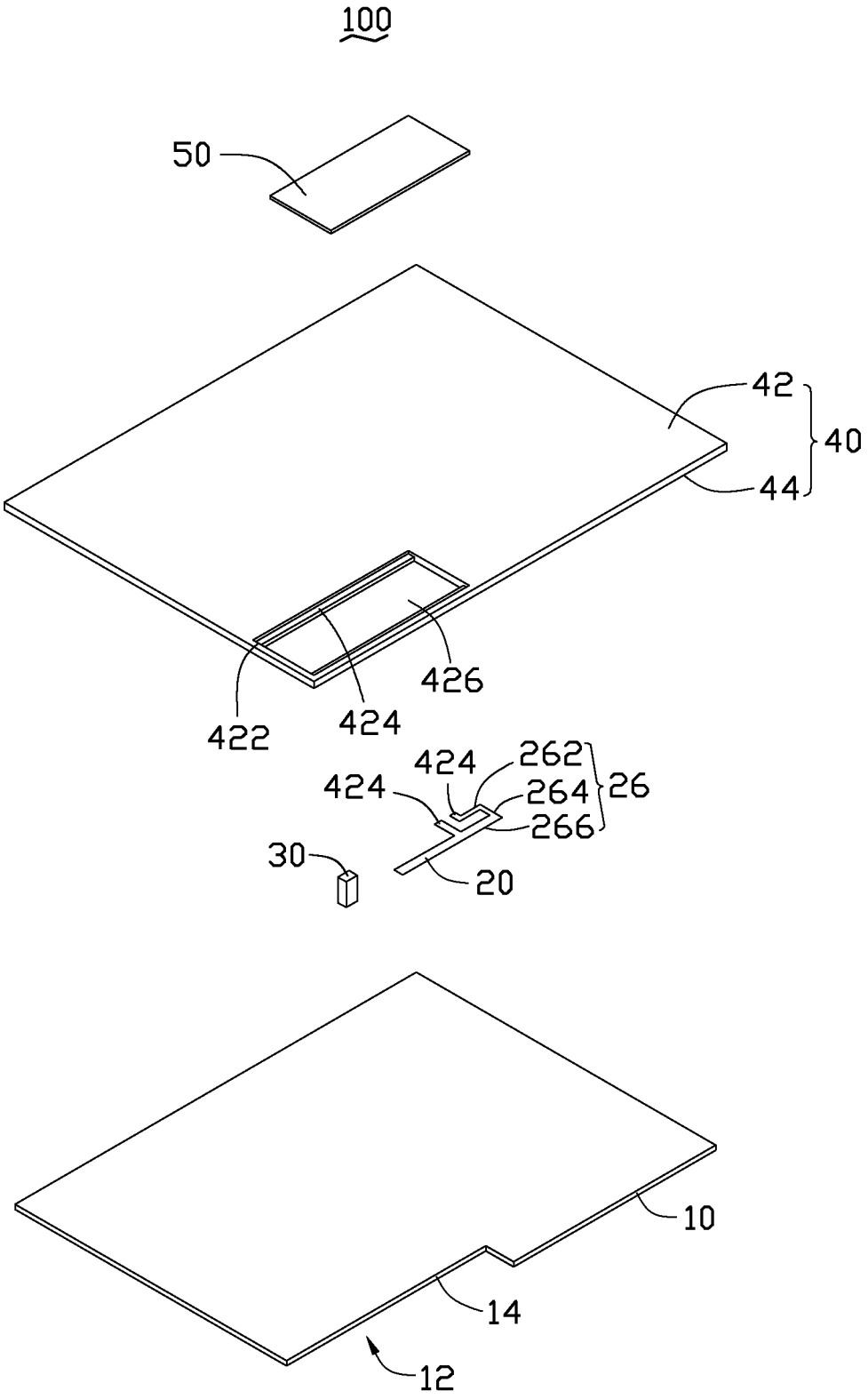
FIG. 2 is an exploded view of the antenna module of FIG. 1 viewed from another angle.

FIGS. 1 and 2 show an exemplary embodiment of a wireless communication device 100 incorporating an antenna module (not labeled). The wireless communication device 100 comprises a circuit board 10, a cover board 40, and the antenna module.

The circuit board 10 defines a notch 12 at one edge. The notch 12 has a sidewall 14 having an electrical feed point (not shown) and a grounding point (not shown) formed thereon. The feed point is configured for feeding current into the antenna module and the grounding point is configured for grounding the antenna module, enabling the antenna module to form a current loop.

The cover board 40 may be a portion of a housing of the wireless communication device 100. The cover board 40 is positioned opposite to the circuit board 10. The cover board 40 includes an outer surface 42 and an inner surface 44 opposite to the outer surface 42 and facing the circuit board 10. The outer surface 42 defines a recess 422 which includes a bottom wall 424. The bottom wall 424 defines an opening 426 through the inner surface 44.

The antenna module comprises an antenna 20, a connecting member 30, a sliding board 50, and a radiation member 60.

The antenna 20 is made of conductive materials, such as metal. In the exemplary embodiment, the antenna 20 is a planar sheet parallel to the circuit board 10 and positioned in the notch 12 of the circuit board 10, to save space. The antenna 20 includes a feeding end 22, a grounding end 24, and a radiation portion 26. The feeding end 22, the grounding end 24, and the radiation portion 26 are all coplanar. The feeding end 22 is electronically connected to the feed point of the circuit board 10, for feeding current into the antenna module. The grounding end 24 is electronically connected to the grounding point of the circuit board 10, for grounding the antenna module. The radiation portion 26 has a first section 262, a connecting section 264, and a second section 266. The first section 262 connects to the grounding end 24. The connecting section 264 extends perpendicularly from the first section 262. The second section 266 extends perpendicularly from the connecting section 264 and is located on a same side of the connecting section 264 as the first section 262. The feeding end 22 connects to a substantially middle portion of the second section 266 and is substantially parallel to the connecting section 264.

The connecting member 30 is made of conductive materials, such as metal. The connecting member 30 detachably and electronically connects the antenna 20 and the radiation member 60. In the exemplary embodiment, the connecting member 30 is a flexible sheet which perpendicularly connects to an end of the second section 266 furthest from the connecting section 264 and extends towards the cover board 40. Length of the connecting member 30 is substantially equal to distance between the circuit board 10 and the cover board 40.

The sliding board 50 is made of plastic or some other non-conductive material. The sliding board 50 is slidably received in the recess 422 of the cover board 40 and opposite to the antenna 20. In the exemplary embodiment, length of the sliding board 50 is smaller than length of the recess 422, enabling the sliding board 50 to be pushed in one direction or another in the recess 422. To ensure the sliding board 50 does not come out of the recess 422, the sliding board 50 may further engage with other body portions of the wireless communication device incorporating the antenna module 100.

The radiation member 60 is made of conductive materials, such as metal. The radiation member 60 is attached to a surface of sliding board 50 facing the circuit board 10 and is exposed from the opening 426. The radiation member 60 may be formed by plating copper coating on the sliding board 50, or by attaching metal sheet to the sliding board 50. The radiation member 60 can also be formed by attaching flexible circuit board on the sliding board 50.

In the exemplary embodiment, the radiation member 60 includes a main radiation section 62 and a contacting section 64. The main radiation section 62 includes a first portion 621, a second portion 623, and a third portion 625. The first and third portions 621, 625 perpendicularly extend from the ends of the second portion 623, and are located on the same side of the second portion 623. Length of the third portion 625 is greater than length of the first portion 621. The contacting section 64 perpendicularly extends from an end of the third portion 625 away from the second portion 623. The contacting section 64 is substantially parallel to the second portion 623. When the sliding board 50 slides in the recess 422, the contacting section 64 makes contact with or separates from the connecting member 30. When the contacting section 64 is in contact with the connecting member 30, length of the current path formed in the antenna 20, the connecting member 30, and the radiation member 60 is in a certain proportion to the wavelength of GPS signals. Thus, the antenna 20, the connecting member 30, and the radiation member 60 cooperatively receive and transmit GPS signals. To ensure a good contact between the connecting member 30 and the contacting section 64, the contacting section 64 may be gold-plated. When the contacting section 64 separates from the connecting member 30, length of the current path formed in the antenna 20 and the connecting member 30 is in a certain proportion to the wavelength of Bluetooth (BT) signals. Thus, the antenna 20 and the connecting member 30 cooperatively receive and transmit BT signals.

The operating principle of the antenna module 100 is as follows.

Figure 3:
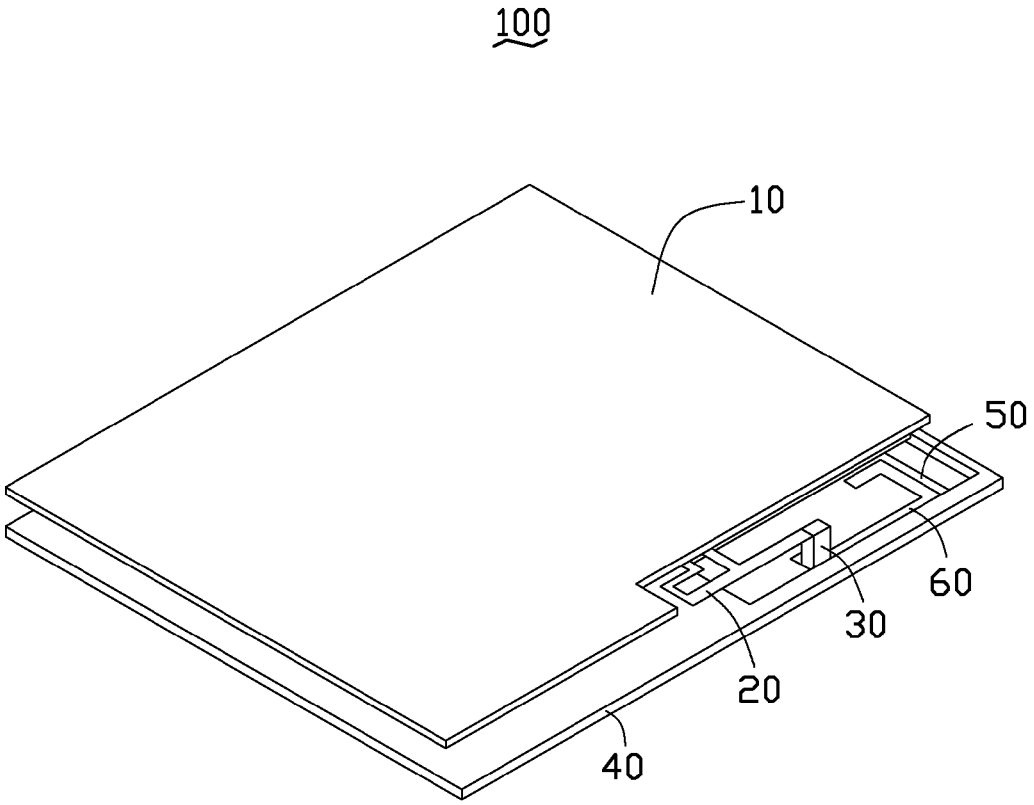
FIG. 3 is an assembled, isometric view of the antenna module of FIG. 1 in a first state.
Figure 4:
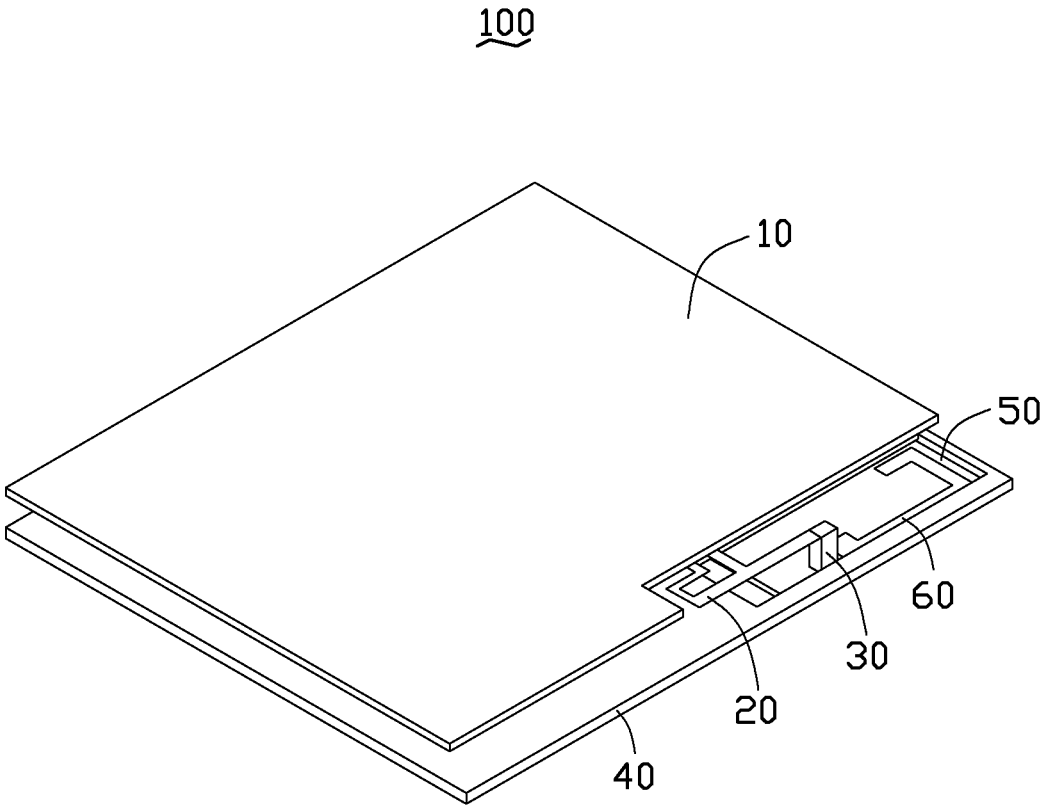
FIG. 4 is an assembled, isometric view of the antenna module of FIG. 1 in a second state.

Referring to FIG. 4, when the antenna module 100 is required to receive and transmit BT signals, the sliding board 50 slides to separate the contacting section 64 from the connecting member 30. At this time, the antenna 20 and the connecting member 30 cooperatively form a BT antenna for receiving and transmitting BT signals. When the antenna module 100 is required to receive and transmit GPS signals, the sliding board 50 can be slid to bring the contacting section 64 into contact with the connecting member 30, as shown in FIG. 3. At this time, the antenna 20, the connecting member 30, and the radiation member 60 cooperatively form a GPS antenna for receiving and transmitting GPS signals.

The BT antenna and the GPS antenna share the same feeding end 22 and the same grounding end 24, without defining independent and separate feeding ends and grounding ends for each of the BT antenna and the GPS antenna, thus effectively decreasing the space required for the antenna module 100 inside the wireless communication device.

It should be understood, that the antenna module 100 is not limited to receiving and transmitting BT and GPS signals. The antenna module 100 can also receive and transmit other signals, such as WIFI signals, by changing the effective size of the antenna 20 and the radiation member 60. In addition, the antenna 20 and the radiation member 60 are not limited to the structures as set forth in the foregoing description, so long as the one or more lengths of current path formed therein is in a certain proportion to the wavelength of a desired wireless signal.

In addition, the antenna module 100 is not limited to receiving and transmitting only two kinds of signals. The antenna module 100 can also be used to receive and transmit more than two different kinds of signals by increasing the number of radiation members corresponding to wireless signals to be received to the sliding board 50.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An antenna module, comprising:
an antenna;
a connecting member attached to the antenna;
a sliding board configured for sliding relative to connecting member; and
a radiation member attached to the sliding board;
wherein when the sliding board slides relative to the connecting member, the radiation member is in contact with or separates from the connecting member; and
wherein when the radiation member contacts the connecting member, the antenna, the connecting member, and the radiation member cooperatively receive and transmit a first signal; when the radiation member separates from the connecting member, only the antenna and the connecting member cooperatively receive and transmit a second signal.

2. The antenna module as claimed in claim 1, wherein the antenna comprises a feeding end, a grounding end, and a radiation portion; the radiation portion has a first section, a connecting section, and a second section; the first section connects the grounding end; the connecting section extends perpendicularly from the first section; the second section extends perpendicularly from the connecting section; the first and second section are located on the same side of the connecting section; the feeding end connects the second section.

3. The antenna module as claimed in claim 1, wherein the radiation member comprises a main radiation section and a contacting section connecting an end of the main radiation section; when the sliding board slides, the contacting section contacts or separates from the connecting member.

4. The antenna module as claimed in claim 3, wherein the main radiation section includes a first portion, a second portion, and a third portion; the first and third portion perpendicularly extend from two ends of the second portion, respectively, and are located on the same side of the second portion; length of the third portion is greater than length of the first portion; the contacting section perpendicularly extends from an end of the third portion away from the second portion and is substantially parallel to the second portion.

5. The antenna module as claimed in claim 1, wherein the connecting member is a flexible sheet.

6. The antenna module as claimed in claim 1, wherein the antenna is electronically connected to a circuit board, the circuit board defines a notch at an edge portion; and the antenna is a planar sheet parallel to the circuit board and is positioned in the notch.

7. The antenna module as claimed in claim 1, wherein the sliding board is slidably attached to a cover board, the cover board comprises an inner surface facing the antenna and an outer surface opposite to the inner surface; the outer surface defines a recess which includes a bottom wall; the bottom wall defines an opening through the inner surface; the sliding board is slidably received in the recess, with the radiation member exposed from the opening.

8. A wireless communication device, comprising:
a circuit board;
a cover board positioned opposite to the circuit board; and
an antenna module, the antenna module comprising:
an antenna electronically connected to the circuit board;
a connecting member attached to the antenna;
a sliding board slidably attached to the cover board to slide relative to connecting member; and
a radiation member attached to the sliding board;
wherein when the sliding board slides relative to the connecting member, the radiation member is in contact with or separates from the connecting member; and
wherein the circuit board defines a notch at an edge portion; and the antenna is a planar sheet parallel to the circuit board and is positioned in the notch.

9. The wireless communication device as claimed in claim 8, wherein the antenna comprises a feeding end and a grounding end; and the feeding end and the grounding end both are electronically connected to the circuit board.

10. The wireless communication device as claimed in claim 9, wherein the antenna further comprises radiation portion; the radiation portion has a first section, a connecting section, and a second section; the first section connects the grounding end; the connecting section extends perpendicularly from the first section; the second section extends perpendicularly from the connecting section; the first and second section are located on the same side of the connecting section; the feeding end connects the second section.

11. The wireless communication device as claimed in claim 8, wherein the cover board comprises an inner surface facing the antenna and an outer surface opposite to the inner surface; the outer surface defines a recess which includes a bottom wall; the bottom wall defines an opening through the inner surface; the sliding board is slidably received in the recess, with the radiation member exposed from the opening.

12. The wireless communication device as claimed in claim 8, wherein the radiation member comprises a main radiation section and a contacting section connecting an end of the main radiation section; when the sliding board slides, the contacting section contacts or separates from the connecting member.

13. The wireless communication device as claimed in claim 12, wherein the main radiation section includes a first portion, a second portion, and a third portion; the first and third portion perpendicularly extend from two ends of the second portion, respectively, and are located on the same side of the second portion; length of the third portion is greater than length of the first portion; the contacting section perpendicularly extends from an end of the third portion away from the second portion and is substantially parallel to the second portion.

14. The wireless communication device as claimed in claim 8, wherein when the radiation member contacts the connecting member, a first current path is formed among the antenna, the connecting member, and the radiation member; when the radiation member separates from the connecting member, a second current path is formed between the antenna and the connecting member.

15. The wireless communication device as claimed in claim 8, wherein the connecting member is a flexible sheet.

* * * * *